US007000792B2

(12) United States Patent
Arai

(10) Patent No.: US 7,000,792 B2
(45) Date of Patent: Feb. 21, 2006

(54) SELF-OPENING CAP MECHANISM

(75) Inventor: Yoshitaka Arai, Tokyo (JP)

(73) Assignee: Takemoto Yoki Co., Ltd., Tokyo (JP)

( * ) Notice: Subject to any disclaimer, the term of this patent is extended or adjusted under 35 U.S.C. 154(b) by 0 days.

(21) Appl. No.: 11/092,337

(22) Filed: Mar. 29, 2005

(65) Prior Publication Data

US 2005/0218105 A1 Oct. 6, 2005

(30) Foreign Application Priority Data

Mar. 31, 2004 (JP) ..... 2004-105467

(51) Int. Cl.
*B65D 39/00* (2006.01)

(52) U.S. Cl. ..... 215/237; 220/810; 220/324

(58) Field of Classification Search ..... 215/237, 215/235; 220/324, 259.1–259.5, 838, 348, 220/823, 359.3, 345.3, 339, 335, 254.5, 254.7, 220/810; 222/153, 517

See application file for complete search history.

(56) References Cited

U.S. PATENT DOCUMENTS

| | | | | |
|---|---|---|---|---|
| 4,170,315 A | * | 10/1979 | Dubach et al. | 220/281 |
| 4,711,360 A | | 12/1987 | Ullman | |
| 4,782,964 A | * | 11/1988 | Poore et al. | 215/216 |
| 4,795,044 A | * | 1/1989 | Beck | 215/237 |
| 5,040,691 A | * | 8/1991 | Hayes et al. | 215/216 |
| 5,083,671 A | * | 1/1992 | Hayes | 215/245 |
| 5,141,138 A | * | 8/1992 | Odet et al. | 222/153.07 |
| 5,392,938 A | * | 2/1995 | Dubach | 215/254 |
| 5,577,626 A | * | 11/1996 | Henkel et al. | 215/237 |
| 5,620,107 A | * | 4/1997 | Takeuchi | 215/235 |
| 5,868,265 A | * | 2/1999 | Kobayashi | 215/235 |
| 5,962,216 A | | 10/1999 | Trouet et al. | |

FOREIGN PATENT DOCUMENTS

| | | | | |
|---|---|---|---|---|
| JP | 7-257617 | * | 10/1995 | 215/235 |
| JP | 8-133319 | * | 5/1996 | 215/235 |
| JP | 8-244819 | * | 9/1996 | 215/235 |
| JP | 2004-67185 | * | 3/2004 | 215/235 |

* cited by examiner

*Primary Examiner*—Lien M. Ngo
(74) *Attorney, Agent, or Firm*—McGlew & Tuttle, P.C.

(57) ABSTRACT

A self-opening mechanism for a cap is capable of maintaining a restoring force of an elastic member and easily and tightly locking the cap and also releasing the locking. The mechanism has an elastic member (4) that is attached to an inner side of a hinge (3), and also a stopper block (7) is provided in a direction in which the elastic member (4) deforms so that the elastic member (4) deforms to an S-shaped form. Engagement pieces (10, 10*a*) in the cap (2) side are inserted into and fixed between hooks (16, 16*a*) of a push piece (18) and a protruding engagement pieces (15, 15*a*) to lock the cap more tightly. As the hook (16, 16*a*) moves upward and moves away from the protruding engagement pieces (15, 15*a*) when the push piece (18) is pressed, the engagement pieces (10, 10*a*) are released and a cover (2) automatically opens due to the restoring force of the elastic member (4).

8 Claims, 3 Drawing Sheets

SELF-OPENING CAP MECHANISM

CROSS REFERENCE TO RELATED APPLICATIONS

This application claims the benefit of priority under 35 U.S.C. § 119 of Japan Application 2004-105467 filed Mar. 31, 2005, the entire contents of which are incorporated herein by reference.

FIELD OF THE INVENTION

The present invention relates to a cap mechanism which automatically opens when touched once.

BACKGROUND OF THE INVENTION

There has been known a cap mechanism formed by coupling a vessel body and a cover with a hinge and setting an elastic material inside the hinge so that, when the cover is closed, energy is stored in the elastic body. When a cover-opening claw based on the pushing system is operated, locking is released and the cover automatically opens due to the restoring force stored in the elastic material.

U.S. Pat. No. 4,711,360 discloses a mechanism provided by an elastic body set in and projecting from a vessel body. This elastic body is bent when the cover is closed, and when locking is released, the cover automatically opens due to the restoring force of the elastic body. However, the locking mechanism for the cover described in U.S. Pat. No. 4,711,360 is not clear.

U.S. Pat. No. 5,962,216 discloses a configuration in which elastic members are placed in a vessel body as well as a hinge section of a hinge cap, and when the cover is closed, the elastic members are compressed, and when locking is released, the cover automatically opened due to the restoring force of the elastic members. In the configuration of U.S. Pat. No. 5,962,216, however, the lock mechanism between the cover and the vessel body is a conventional one, and there is not any specific contrivance.

In Japanese Patent Laid-Open Publication No. 2002-211615 a typical automatic operation of a cap is enabled by operating a button. However, a plate member for operation is provided on an upper surface of the cap body, and once the cap cover is opened, the plate member or the structure around the plate member is in full view, so that the appearance is not good. According to Japanese Patent Laid-Open Publication No. 2002-211615, the cap body 2 has the deck panel section 10 for preventing the content from leaking in the movable section to deteriorate the smooth movement of the cap, and further most of the portion of the operating member 5 for transferring a pushing-in and opening drive force to the inside of the hinge 4 is hidden even when the cap cover 3 is opened, so that the appearance is improved and the content hardly infiltrates into the movable section of the operating member 5, so that the smoothness of the movement is not lost. With the invention of Japanese Patent Laid-Open Publication No. 2002-211615, however, there is not any specific contrivance for a locking mechanism for the cover.

Japanese Patent Laid-Open Publication No. H7-291326 improves the smoothness in an operation for opening a cap based on the so-called three-point hinge system. With this, the cover body 20 for opening and closing an outlet port is rotatably provided with the first hinge 31 in the cap body 10 having the outlet port. The substantially house shoe-shaped band plate 40 is provided between the cap body 10 and the cover body 20. The band plate 40 functions as a plate spring with one edge thereof rotatably attached via the second hinge 32 to the cap body 10 and further with the other edge of the band plate 40 rotatably attached via the third hinge 33 to the cover body 20. A hooking projection for engagement when fully closed is provided in a front edge section of the cap body as well as in a front edge section of the cover body 20, and a rotation center of the third hinge 33 when fully opened is set to be at the outer side of a virtual line C passing through a rotation center of the first hinge 31 and that of the second hinge 32.

However, also in the invention of Japanese Patent Laid-Open Publication No. H7-291326 there is not any specific contrivance for the engagement mechanism of the cap.

Japanese Utility Model Registration No. 3091998 has an object of the disclosed device to provide a self-opening hinge cap which can be produced with low cost. In the configuration, the cover is monolithically formed via the hinges 3, 3*a* on the cap body 1 using a molding die for injection molding. The cap body 1 and the cover 2 are coupled to each other at the positions of the hinges 3, 3*a* with an elastic opening member 4, and with the compressing action of this elastic opening member 4, the cover 2 is automatically opened around the hinges 3, 3*a*. Also the elastic opening member 4 is monolithically molded (by means of two-color injection molding) using a molding die for injection molding when the cover 2 is molded.

Also in the device of Japanese Utility Model Registration No. 3091998, there is not any particular contrivance for the locking mechanism for the cap.

SUMMARY OF THE INVENTION

An object of the present invention is to provide a self-opening cap mechanism for a cap having an elastic member incorporated inside a hinge and capable of self-opening by 90 degrees or more with a restoring force of this elastic member, and with this cap mechanism, locking is carried out without fail and also the locked state can easily be released with an easy operation.

To achieve the object described above, the invention provides a self-opening cap mechanism formed with a vessel body and a cap coupled to each other with a hinge and comprising an elastic member with the base section fixed to the vessel body side and a tip thereof extending up to a corner section inside the cap. This self-opening cap mechanism is characterized in that a stopper block is formed in the vessel body side and also inside the elastic member and the elastic member is deformed to a S-shaped form due to this stopper block when the cap is closed.

A notched section is formed in the cap in the side opposite to the hinge and two engagement pieces are formed with a space therebetween inside this notched section. A circular cap-side rib is formed at a position inwardly from the engagement pieces with a small clearance therefrom.

The vessel body has a vessel-side rib formed around a port of the vessel. Two protruding engagement pieces projecting outwardly from this rib are formed. Hooks facing against the engagement pieces respectively are formed at positions outwardly from the engagement pieces. Further, a push piece with the hook side rotating around a support point thereof is provided for releasing the locked state.

The elastic member may comprise a band plate.

The present invention having the configuration as described above provides the following effects and advantages.

1. As a stopper block is formed inside the elastic member, so that deformation of this elastic member is restricted by this stopper block to an S-shaped form and then a force accumulated in this elastic body increases and a self-opening operation thereof can be performed smoothly, and the restoring force is not lost even when fatigue is generated in the elastic member.

2. The locking mechanism effects locking by holding the engagement pieces in the cap side between the protruding engagement pieces and the hooks in the vessel side, so that the locked state is secure and in addition the locked state can be released only by slightly pushing the push piece 18.

3. All of the components excluding the elastic member can monolithically molded, which enables cost reduction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
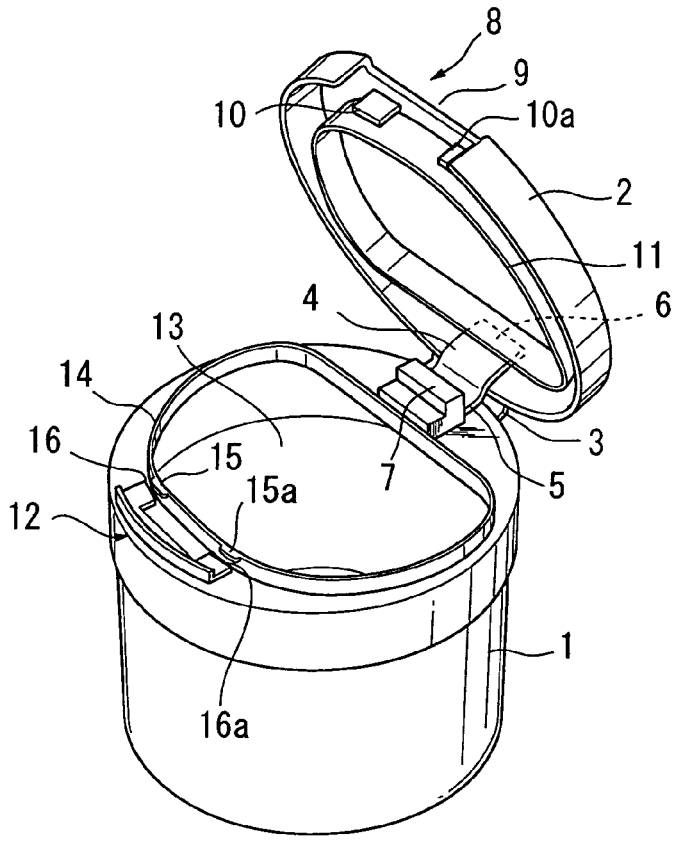
FIG. 1 is an explanatory perspective view illustrating a vessel and a cap for which a self-opening mechanism for the cap according to the present invention is applied.
Figure 2:
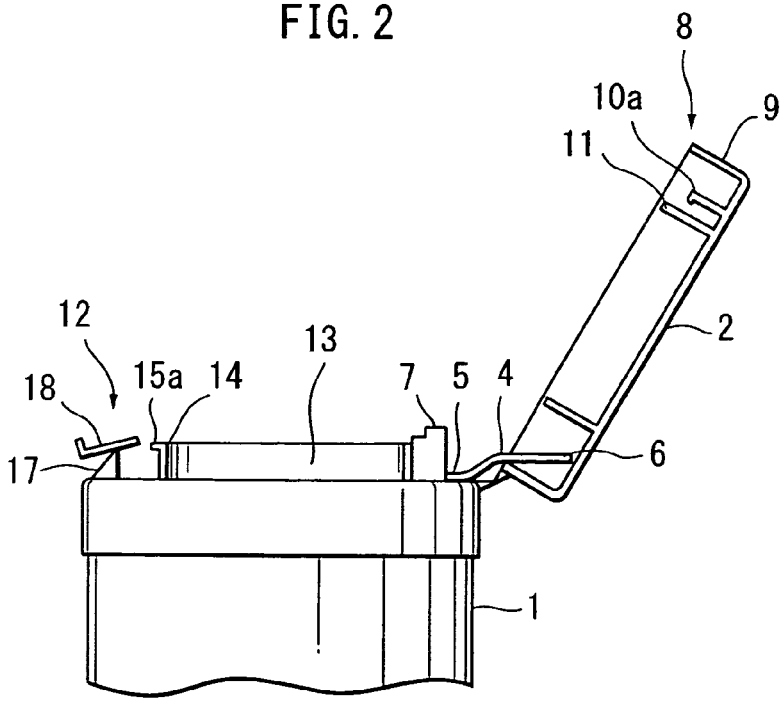
FIG. 2 is side view illustrating a vessel and a cap for which a self-opening mechanism for the cap according to the present invention is applied.
Figure 3A:
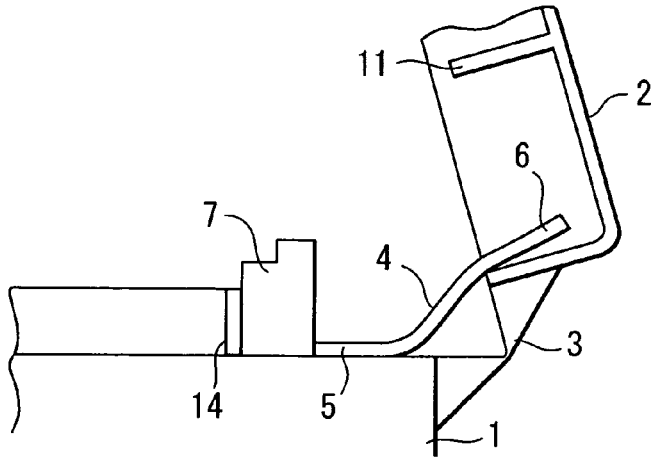
FIG. 3A is a partially broken away sectional view for illustrating action of the self-opening mechanism.
Figure 3B:
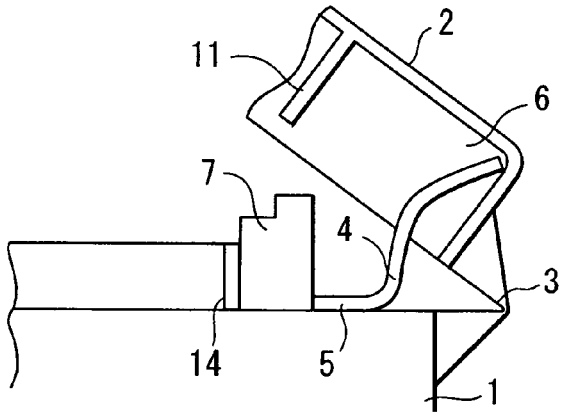
FIG. 3B is another partially broken away sectional view illustrating the action of the self-opening mechanism.
Figure 3C:
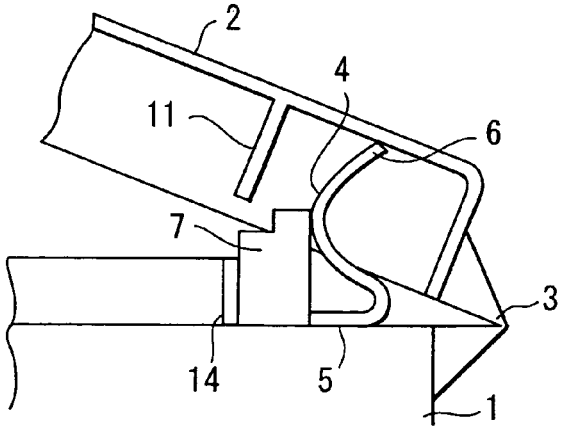
FIG. 3C is another partially broken away sectional view illustrating the action of the self-opening mechanism.
Figure 3D:
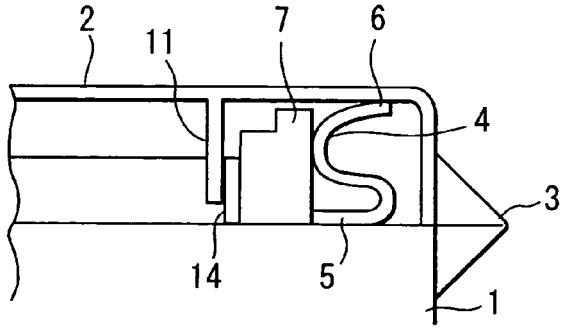
FIG. 3D is another partially broken away sectional view illustrating the action of the self-opening mechanism.
Figure 4A:
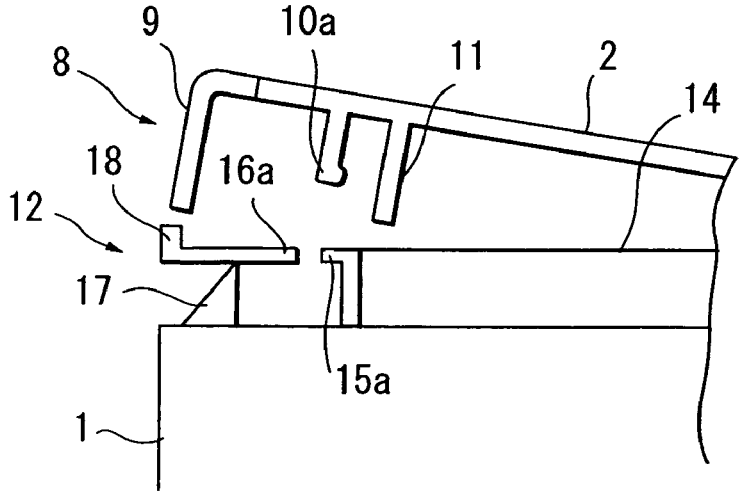
FIG. 4A is a partially broken away sectional view illustrating the action of the locking mechanism.
Figure 4B:
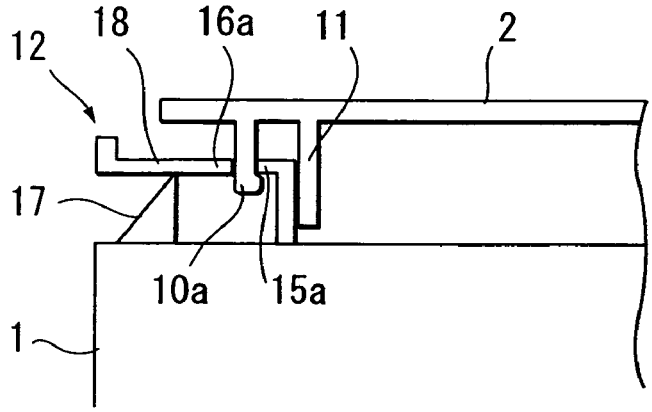
FIG. 4B is another partially broken away sectional view illustrating the action of the locking mechanism.
Figure 4C:
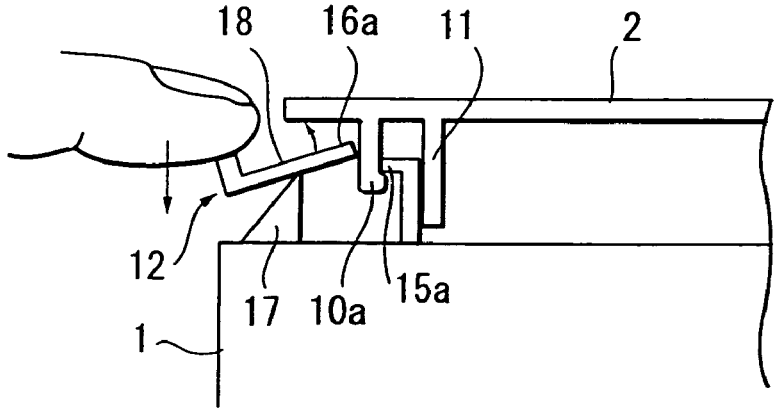
FIG. 4C is another partially broken away sectional view illustrating the action of the locking mechanism

Referring to the drawings in particular, FIG. 1 is a perspective view showing a self-opening cap mechanism according to the present invention, FIG. 2 is a side view showing a cross section of a cap and a port section of a vessel body, FIG. 3(A) to FIG. 3(D) are views for illustrating actions of the self-opening mechanism; and FIG. 4(A) to FIG. 4(C) are views for illustrating actions of the locking mechanism.

A vessel body 1 is linked with a hinge 3 to a cap 2 to form a monolithic body, and a base section 5 of this hinge 3 in the inner side thereof is fixed to the vessel body 1. An elastic member 4 has a tip edge section 6 extending to a corner section in the inner side of the cap 2. The elastic member 4 is attached to the vessel body 1. The reference numeral 7 indicates a stopper block provided in the vessel body 1 and formed inside the elastic member 4. When the cap 2 is closed with the stopper block 7, deformation of the elastic member 4 is restricted, and is finally deformed to a S-shaped forming an energized state.

The reference numeral 8 indicates an engagement section for the cap 2, and this engagement section 8 has a notched section 9 in the side opposed to the hinge 3. Two engagement pieces 10 and 10*a* are formed inside this notched section 9. Further, a cap-side rib 11 having a circular form is formed at a position inwardly (radially inwardly) from the engagement sections 10, 10*a* with a small clearance therefrom.

The reference numeral 12 is a push device, and this push device has the configuration in which a vessel-side rib 14 is formed around a port 13 of the vessel body 1. Two protruding engagement pieces 15, 15*a* are formed each extending outward from this rib 14. Hooks 16, 16*a* each extending inward are formed at two positions outwardly (radially outwardly) from the protruding engagement pieces 15,15*a*. A push piece 18 is formed at a supporting piece 17 as a center which oscillates the hooks 16, 16*a* in the vertical direction.

In aforementioned self-operating mechanism, when the cap is closed from the state shown in FIG. 3A to the state shown in FIG. 3B, the elastic member 4 deforms into the S-shaped form as the deformation is suppressed by the stopper block 7. When the cap 2 is further closed, the elastic member 4 stopped by the stopper block is compressed to the S-shaped form with energy stored therein.

On the other hand, in the locking mechanism, when the cap 2 is closed from the state just before the cap 2 is closed as shown in FIG. 4A to the state as shown in FIG. 4B, the engagement pieces 10, 10*a* go into sections between the protruding engagement pieces 15, 15*a* and the hooks 16, 16*a*, and locking is effected.

To release locking, when the push piece 18 is pressed down as shown in FIG. 4C, the hooks 16, 16*a* escape upward, so that the engagement pieces 10. 10*a* are removed from the protruding pieces 15, 15*a* and the cap 2 automatically opens due to the restoring force of the elastic member 4.

While a specific embodiment of the invention has been shown and described in detail to illustrate the application of the principles of the invention, it will be understood that the invention may be embodied otherwise without departing from such principles.

What is claimed is:

1. A self-opening cap comprising:

a vessel body;

a cap;

a hinge for coupling said vessel body to said cap;

an elastic member with the base section fixed to said vessel body on an inward side of said hinge, said elastic member having a tip section extending to a corner section inside said cap, said vessel body having a stopper block formed in said vessel body on an inward of said elastic member, and said elastic member being deformed with said stopper block to a S-shaped form when said cap is closed, said cap having a notch section formed in said caps at a side opposed to said hinge, two engagement pieces being formed with a clearance therebetween inside said notched section and said cap having a circular cap-side rib formed at a position inwardly from said engagement pieces with a small clearance therefrom, said vessel body having a vessel-side rib formed around a portion of said vessel body, two protruding engagement pieces are formed each extending outward from said vessel-side rib with hooks provided facing against said protruding engagement pieces respectively and formed at positions outwardly from said protruding engagement pieces and a push piece providing said hooks with hook-side portions, said push piece disposed for oscillating in the vertical direction around a supporting position for releasing the locked state.

2. The self-opening cap mechanism according to claim 1, wherein said elastic member comprises a band-like member.

3. A vessel and cap combination, comprising:

a vessel body having a surface with a stopper block, having a vessel-side rib around a portion of said vessel body with two protruding engagement pieces extending outwardly from said vessel-side rib, a push piece with hook-side portions having hooks facing against said protruding engagement pieces respectively at positions outwardly from said protruding engagement pieces to define a locked position, said push piece being disposed for oscillating in the vertical direction around a supporting position for moving to a released position;

a cap having a notch section defining a clearance with two engagement pieces formed in a region of said clearance, and having a circular cap-side rib formed at a position inwardly from said engagement pieces with a small clearance therefrom;

a hinge coupling said vessel body to said cap;

an elastic member with the base section fixed to said vessel body on an inward side of said hinge, said elastic member having a tip section extending to a surface inside said cap, said elastic member being deformed with said stopper block to a S-shaped form when said cap is closed.

4. A vessel and cap combination according to claim 3, wherein said elastic member comprises a band-like member.

5. A vessel and cap combination according to claim 3, wherein said vessel body, said cap and said hinge are a monolithically molded integral part.

6. A container, comprising:

a vessel body having a stopper block and a vessel-side rib around a portion of said vessel body with a protruding engagement piece extending outwardly from said vessel-side rib, said vessel body having a push piece with a hook facing against said protruding engagement piece at a position outwardly from said protruding engagement piece to define a locked position, said push piece being disposed for moving with respect to a supporting position for moving from said locked position to a released position;

a cap having a cap engagement piece and having a cap-side rib formed at a position inwardly from said cap engagement piece with a small clearance therefrom;

a hinge connecting said vessel body to said cap;

an elastic member with a base section disposed relative said vessel body and having a tip section extending to a surface inside said cap, said elastic member being in contact with said stopper block to bend when said cap is closed.

7. A container according to claim 6, wherein said elastic member comprises a band member.

8. A container according to claim 6, wherein said vessel body, said cap and said hinge are a monolithically molded integral part.

* * * * *